US006603256B1

(12) United States Patent
Itoh et al.

(10) Patent No.: US 6,603,256 B1
(45) Date of Patent: Aug. 5, 2003

(54) FIELD EMISSION TYPE DISPLAY

(75) Inventors: Goh Itoh, Kanagawa-ken (JP); Haruhiko Okumura, Kanagawa-ken (JP); Miki Mori, Kanagawa-ken (JP); Yumi Fukuda, Kanagawa-ken (JP); Hisao Fujiwara, Kanagawa-ken (JP); Yujiro Hara, Kanagawa-ken (JP); Hitoshi Kobayashi, Kanagawa-ken (JP); Masahiko Yamamoto, Kanagawa-ken (JP); Masayuki Saito, Kanagawa-ken (JP); Masayuki Nakamoto, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/526,468

(22) Filed: Mar. 15, 2000

(30) Foreign Application Priority Data

Mar. 30, 1999 (JP) ..... 11-087744
Mar. 14, 2000 (JP) ..... 2000-069825

(51) Int. Cl.[7] ..... H01J 63/04

(52) U.S. Cl. ..... 313/496; 313/495; 315/169.1; 315/169.3

(58) Field of Search ..... 313/496, 495, 313/309, 336, 351; 445/24, 25, 50, 51; 315/169.1, 169.3, 168

(56) References Cited

U.S. PATENT DOCUMENTS 5,262,698 A * 11/1993 Dunham ..... 315/169.1
5,489,933 A * 2/1996 Betsui et al. ..... 347/120
5,499,938 A 3/1996 Nakamoto et al. ..... 445/50
5,567,882 A 10/1996 Ichimura et al. ..... 73/717
5,629,782 A 5/1997 Ichimura et al. ..... 359/9
5,747,926 A 5/1998 Nakamoto et al. ..... 313/495
5,749,762 A 5/1998 Nakamoto et al. ..... 445/50
5,786,656 A 7/1998 Hasegawa et al. ..... 313/308
5,808,408 A 9/1998 Nakamoto ..... 313/484
5,834,324 A 11/1998 Nakamoto ..... 438/20
5,977,693 A 11/1999 Nakamoto et al. ..... 313/45
6,031,328 A 2/2000 Nakamoto ..... 313/495
6,097,138 A 8/2000 Nakamoto ..... 313/309
6,340,962 B1 * 1/2002 Konishi ..... 345/75.2
6,515,429 B2 * 2/2003 Russ et al. ..... 315/169.3

FOREIGN PATENT DOCUMENTS

JP 7-235258 9/1995

* cited by examiner

*Primary Examiner*—David V. Bruce
*Assistant Examiner*—Jurie Yun
(74) *Attorney, Agent, or Firm*—Oblon, Spivak, McClelland, Maier & Neustadt, P.C.

(57) ABSTRACT

There is provided a field emission type display which is capable of suppressing deterioration of image quality which otherwise occurs due to stepwise cuts and to the increase of wiring resistance caused by a thin width of a cathode line and which causes less failures. The display includes a plurality of cathode lines having an equal line width within the pixel and is structurally based on a multiple gradation representing a scheme of controlling spatial gradation display by changing the number of field emission type emitters to be driven by changing the number of cathode lines to be selected.

27 Claims, 16 Drawing Sheets

FIELD EMISSION TYPE DISPLAY

BACKGROUND OF THE INVENTION

1. Field of the Invention

The present invention relates to a field emission type display capable of displaying multiple gradations.

2. Description of the Related Art

A field emission type display comprises emitter electrodes connected to cathode lines, gate electrodes and anode electrodes. A fluorescent substance is coated on the anode electrodes. The emitter electrode emits electrons corresponding to an electric field between the gate electrode and the emitter electrode. A high potential difference is applied between the emitter electrode and the anode electrode. The high potential difference accelerates the electrons emitted from the emitter electrode in the direction of the anode electrode. The electrons reaching the anode electrode cause the fluorescent substance to glow, thus making a luminescent spot per pixel. Accordingly, the quantity of luminescence of the fluorescent substance may be controlled by the quantity of electrons emitted from the emitter electrode.

An areal gradation method for a liquid crystal display has been proposed in Japanese Patent Laid-Open No. Hei. 4-242223. An intersection of a scan line electrode and a signal line electrode corresponds to a pixel here because it is a liquid crystal display. When an electric field is produced between the scan line electrode and the signal line electrode, a liquid crystal layer sandwiched by both electrodes becomes transparent or opaque.

In the document described above, signal lines, each having a different line width, are provided within one pixel so as to function as if one pixel is divided corresponding to the width of the signal line. Five signal lines P1, P2, P3, P4 and P5 are provided within one pixel as shown in FIG. 16, which shows a conventional liquid crystal display. Here, the respective signal lines have the width ratio of 1, ½, ½, ¼ and ¼. Further, a signal line P3 has a width of ½ and is covered by a filter provided with a window P6 having one half of the area of a signal line P2. A signal line P4 has a width of ¼ and is covered by a filter having a window P7 having the same height as the signal line P3. A signal line P5 has a width of ¼ and is covered by a filter provided with a window P8 having one half of the area of the signal line P4. Thereby, display areas corresponding to the gradations of 1, ½, ¼, ⅛ and 1/16 may be created.

While signal lines having different line widths are provided within one pixel in this method, the width of the cathode line electrode for reproducing the first gradation must be very thin as compared to the width of one pixel in order to represent 256 gradations. For instance, the width is set at 1/16 of the width of the pixel and the window is set at 1/16. When the line width is calculated in trial without any window as a quick estimation, and when the size of the pixel is set at 150 $\mu$m (vertical)×450 $\mu$m (horizontal) and the pitch between the cathode lines is set at 10 $\mu$m, the least width of the cathode line turns out to be 0.27 $\mu$m which is difficult to fabricate. Further, the wiring cannot be formed uniformly because the width of the cathode line differs; therefore, the image quality may deteriorate due to stepwise cuts (phenomenon in which the wire is cut in the current path) and to the increase of wiring resistance. It also becomes difficult to contact the cathode lines with the cathode line driving circuit, thus causing a failure.

Accordingly, while the areal gradation method has been proposed for the conventional field emission type display, the wiring cannot be uniform because the width of the cathode line is different and the image quality deteriorates due to the stepwise cuts and to the increase of wiring resistance. It is also difficult to contact the cathode lines with the cathode line driving circuit as described above.

SUMMARY OF THE INVENTION

Accordingly, an object of the present invention is to provide a field emission type display which is capable of suppressing the deterioration of the image quality which otherwise occurs due to the stepwise cuts and to the increase of the wiring resistance caused by the width of the cathode line and which causes less failures by improving the conduction between an emitter electrode and the cathode line.

The inventive display provides pixels disposed on a display substrate in a matrix in X and Y directions. A plurality of field emission type emitters is provided within one pixel and gate electrodes for switching the field emission type are provided, respectively. An opposed substrate having an anode electrode and fluorescent substance is disposed so as to face the display substrate.

The display also comprises a plurality of cathode lines disposed in the column direction to drive the field emission type emitters and gate lines for driving the pixels in the row direction in common.

The display also comprises a gate line driving circuit for supplying voltage to the gate lines, a cathode line driving circuit for supplying voltage to the cathode lines and an anode electrode driving circuit for supplying voltage to the anode electrode.

The invention display has the line width of the cathode lines within one pixel the same and implements the areal gradation representing scheme by differentiating the area of the emitters emitting light within one pixel.

Besides the lines with equal width, lines having a width dispersion of around 10% are also considered to be the same in the cathode line width described above, because the effect of the present invention may be fully obtained even if the line width differs by around 10%. This includes slight modification of the line width in the designing step besides the dispersion of products caused during manufacturing.

The specific nature of the present invention, as well as other objects, uses and advantages thereof, will clearly appear from the following description and from the accompanying drawings.

The present invention is directed to a field emission display comprising an anode; a fluorescent layer on said anode; a board spaced apart from said anode; a plurality of cathode lines parallel to each other on said board; an insulating layer on said cathode lines; a gate electrode on said insulating layer, and said gate electrodes disposed above and may be substantially perpendicular to said cathode lines; and emitter elements connected to said cathode lines, and said emitter elements exposed from openings on said gate electrode and said insulating layer, wherein a cross point of said plurality of cathode lines and said gate electrode forms a pixel, numbers of said emitter elements connected to each cathode line are different in said pixel.

The present invention introduces a field emission display comprising an anode; a fluorescent layer on said anode; a board spaced apart from said anode; a plurality of cathode lines parallel to each other on said board; a first insulating layer having through holes and disposed on said cathode lines; emitter electrodes on said first insulating layer, and each of said emitter electrode connected to one of said cathode lines via a contact in a respective one of said through holes; a second insulating layer; a gate electrode on said second insulating layer, and said gate electrodes disposed above and may be substantially perpendicular to said cathode lines; and emitter elements formed on said emitter electrodes, and said emitter elements exposed from openings on said gate electrode and said second insulating layer, wherein a cross point of said plurality of cathode lines and said gate electrode forms a pixel, numbers of said emitter elements connected to each cathode line are different in said pixel.

The present invention further introduces a driving method for a field emission display comprising impressing a pulse selected from pulses having different duty ratios to at least one of said cathode lines corresponding to an image signal for said pixel.

DESCRIPTION OF THE PREFERRED EMBODIMENTS

The present invention is understood more deeply by the following embodiments which are illustrative but not restrictive.

A first embodiment of the present invention is explained.

Figure 1:
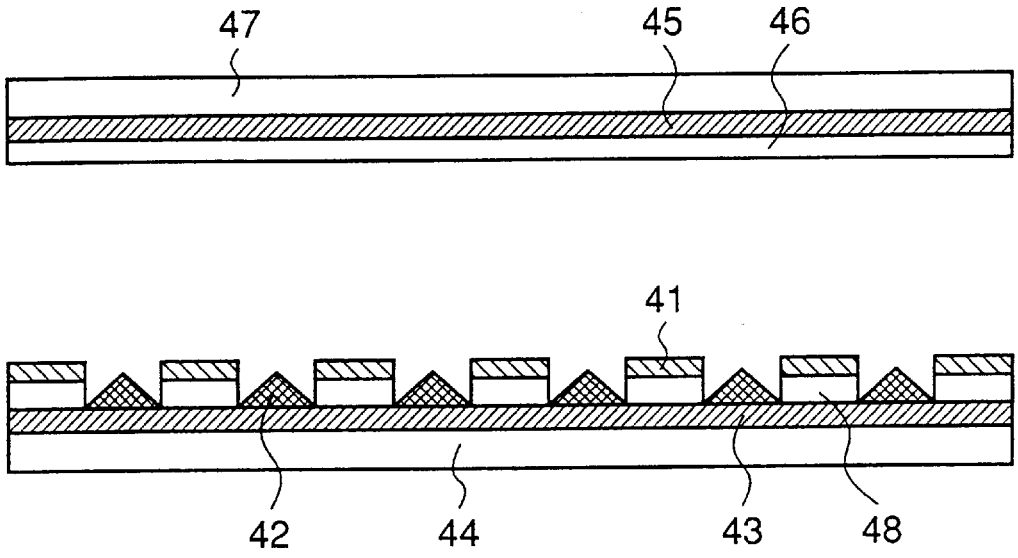
FIG. 1 is a schematic diagram showing the cross-sectional structure of an array according to a first embodiment of the present invention.

FIG. 1 is a schematic diagram showing the cross-sectional structure of an array according to a first embodiment of the present invention. A field emission type display comprises field emission type emitter elements 42 connected to cathode lines 43 and gate electrodes 41 for switching the emitter elements 42 on a display substrate 44 as shown in FIG. 1. An insulating layer 48 is provided between the cathode line 43 and the gate electrode 41. An opposed substrate 47 having an anode electrode 45 and a fluorescent layer 46 is disposed so as to face the display substrate 44. The anode electrode 45 is disposed across the opposed substrate 47.

Here, the display substrate 44 is made of an insulating substrate such as glass. The cathode line 43 is Al wire, for example, and has a line thickness of around 1 to 10 $\mu$m. The emitter element 42 is made of Mo, for example, and is formed into a conical shape having a height of 1 to 10 $\mu$m and a sharp edge. The gate electrode 41 is made of Al, Cu or the like. The insulating layer 48 is made of $SiO_2$, for example, and has a thickness of 0.01 to 1.0 $\mu$m. Or, the insulating layer 48 is formed into a film of 3 to 10 $\mu$m of thickness by using an organic PI film. The opposed substrate 47 is made of glass, for example, and has a thickness of about 0.5 mm. The anode electrode 45 on the opposed substrate 47 is made of ITO (transparent conductive film), for example, and has a thickness of about 0.01 to 0.3 $\mu$m. White fluorescent substance is used for the fluorescent layer 46 in displaying in monochrome or red; green and blue fluorescent substances are used in displaying in color. The fluorescent substances used in a CRT and the like may be also used for these fluorescent substances.

Figure 2:
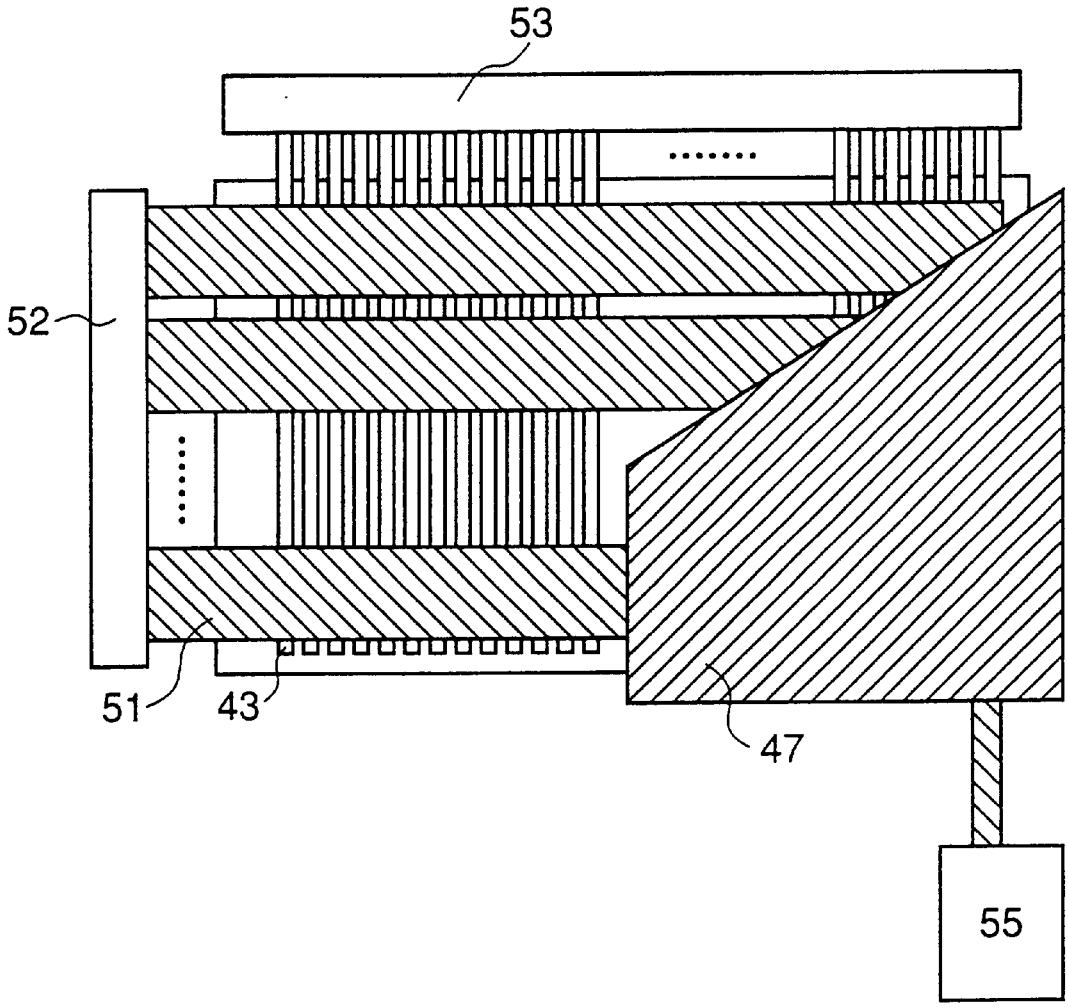
FIG. 2 is a schematic diagram showing the structure of a panel according to the first embodiment of the present invention.

FIG. 2 is a schematic diagram showing the structure of a panel according to the first embodiment of the present invention. A gate line 51 connected to the gate electrodes 41 is disposed in parallel with the X direction and cathode lines 43 are disposed in parallel with the Y direction. A pixel is formed at the intersection of the gate line 51 and the cathode line 43. Accordingly, the pixels are disposed on the display substrate 44 in a matrix in the X and Y direction (row and column directions).

The display also comprises a gate line driving circuit 52 for supplying voltage to the gate line 51, a cathode line driving circuit 53 for supplying voltage to the cathode line 43 and an anode electrode driving circuit 55 for supplying voltage to the anode electrode 45.

Figure 3:
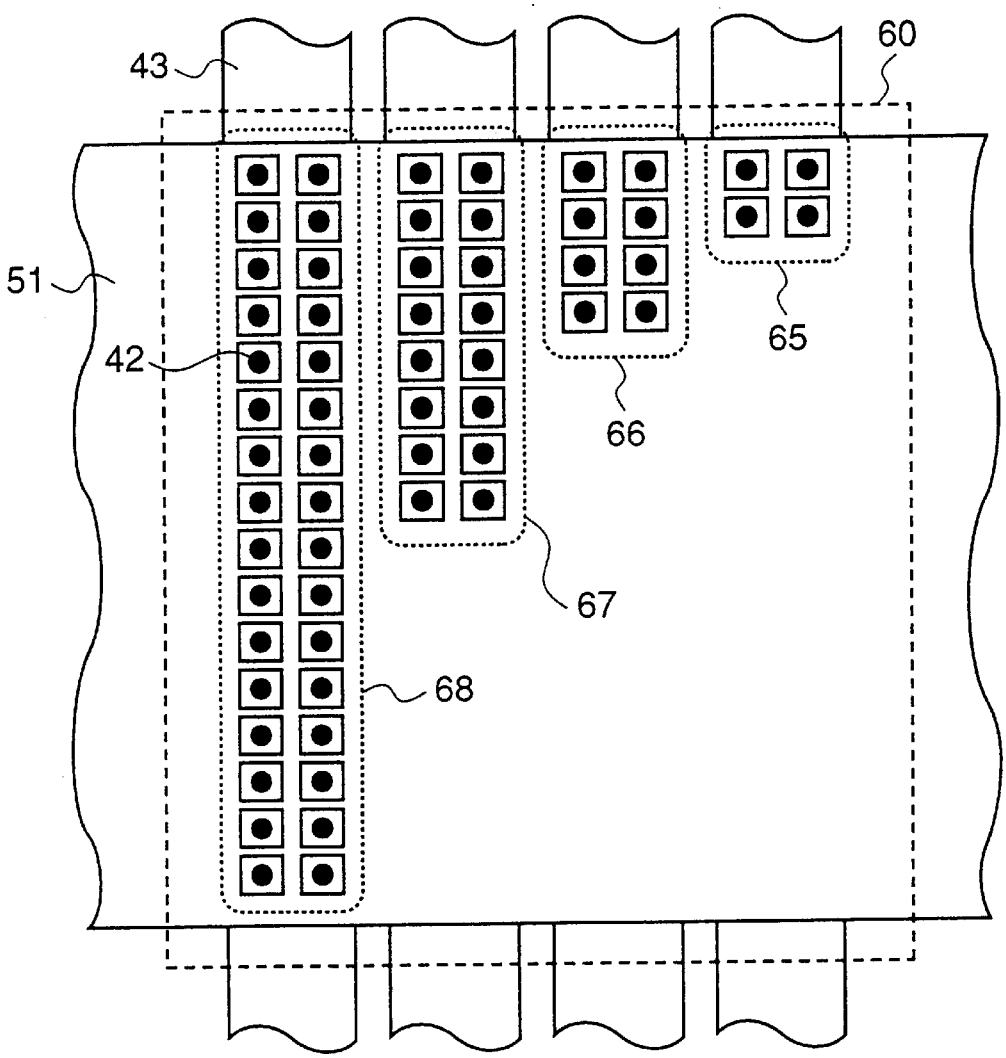
FIG. 3 is a diagram showing the structure of the array according to the first embodiment of the present invention.

FIG. 3 is a schematic diagram showing the array structure of the first embodiment.

One pixel area 60 is an area surrounded by dot lines. In the present embodiment, four cathode lines 43 are disposed in the vertical direction and one gate line 51 is disposed in the horizontal direction. Their intersection composes the one pixel area 60.

Here, the size of the one pixel area 60 is 100 $\mu$m in the vertical and horizontal directions, the line width of the cathode line 43 is 25 $\mu$m and the line width of the gate line 51 is 100 $\mu$m, for example.

Then, areas 65, 66, 67 and 68 are formed by providing different numbers of field emission type emitter elements 42 on the cathode lines 43. In the present embodiment, the line width of the four cathode lines 43 is the same within the areas 65, 66, 67 and 68. Then, four emitter elements 42 are provided in the area 65, eight emitter elements 42 are provided in the area 66, sixteen emitter elements 42 are provided in the area 67 and thirty-two emitter elements 42 are provided in the area 68 on the respective cathode lines 43.

The emitters 42 may be formed in various ways. A first method includes forming only the emitter elements 42 in the respective areas 65, 66, 67 and 68 and then forming the gate electrodes 41 after forming the insulating layer 48 thereon. A second method includes forming the emitter elements 42 uniformly on the cathode lines 43 and selectively exposing only a required number of emitter elements 42 after forming the insulating layer 48 thereon. In the second method, the non-exposed emitter elements exist under the gate electrodes. The emitter elements under the gate electrodes may be utilized also as redundant elements in place of defective elements.

A scan signal is applied selectively to the gate line 51 in the X direction per line in displaying an image. While an image signal of the desired image for a pixel is applied to the cathode line 43 in synchronism with the scan signal, the cathode line to which the image signal is to be applied is selected among the four cathode lines 43 corresponding to the luminance of the image signal. For instance, when voltage is applied to the cathode line 43 at the left edge of the figure, electrons are emitted from the emitter elements 42 in the area 68 and when voltage is applied to the cathode line 43 at the right edge of the figure in contrary, electrons are emitted from the emitter elements 42 in the area 65. Because the luminance is proportional to the quantity of emitted electrons, the luminance may be controlled by the number of emitter elements 42 which emit electrons. The state in which electrons are emitted from the emitter element 42 is expressed as that the emitter element 42 is "ON" hereinbelow.

Here, the voltage of the scan signal is 0 to 90 V, the voltage of the image signal is 0 to 30 V and the anode voltage is around 200 V. The image signal to be displayed at the position of the gate line 51 selected by the scan signal is applied to the cathode line 43.

For instance, if the luminance of the emitter elements 42 only in the area 65 is 4 when they are ON, the luminance of the area 66 is 8 in the ON state, the luminance of the area 67 is 16 in the ON state and the luminance of the area 68 is 32 in the ON state. When the areas 65 and 66 are ON, the luminance turns out to be 12. Sixteen gradations of luminance 0, 4, 8, 12, 16, 20, 24, 28, 32, 36, 40, 44, 48, 52, 56, and 60 may be rendered by applying voltage by selecting the four cathode lines 43 as described above.

Thus, it is not necessary to form an extremely thin line because the width of the cathode line is equal in the embodiment described above. Accordingly, it is possible to avoid the deterioration of the image quality which is caused by the stepwise cuts of the wire and the increase of its resistance. The reduction of the wire resistance is important because the cathode line is long in the vertical direction.

An electric current is supplied from the cathode line to emit electrons from the emitter elements in the field emission type display. That is, it is a current driving type device. Meanwhile, a liquid crystal display is a voltage driving type device, in which the control of potential is important.

It is also possible to display multiple gradations while equalizing or almost equalizing the width of the respective cathodes lines by simply changing the number of emitter elements within one pixel. Accordingly, this enables the emitter elements to be readily fabricated and improves the display characteristics considerably. The emitters may be fabricated precisely. The number of emitters is limited by the width of the cathode line in which the emitters are provided in the field emission type display. Accordingly, the width of the cathode line is kept constant for high yields and uniform fabrication of the emitter elements.

The present embodiment also allows power consumption to be reduced by dividing the cathode lines because voltage fluctuation among the respective cathode lines may be reduced when the pixels correlate in the column direction. Here, the correlation between two pixels means that the luminance of those pixels are close to each other. For instance, when power consumption within one pixel is concerned, voltage fluctuation always occurs once corresponding to the time when the gate line to which the scan voltage is applied is switched in all gradations except the zero-th and 16-th gradations in the array structure using one cathode line per one pixel. However, because there are cathode lines which cause no voltage fluctuation due to the gradation when the cathode line is divided into four lines as in the present embodiment, the power consumption of that cathode line is zeroed. When the probability of the voltage fluctuation per gradation is found and the low power consumption effect is estimated in the quartering method, the power consumption is estimated to be ½ or less as compared to the prior art case without dividing.

Figure 4:
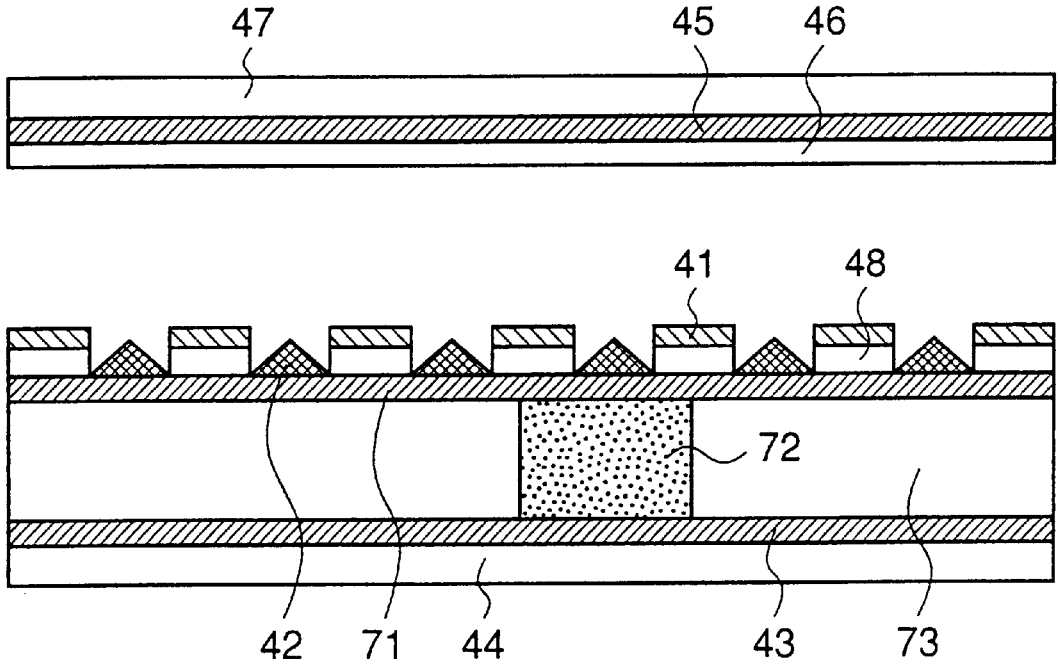
FIG. 4 is a schematic diagram showing the sectional structure of an array according to a second embodiment of the present invention.

A second embodiment is explained with reference to FIG. 4, which is a schematic diagram showing the sectional structure of an array.

The field emission type emitters 42 are provided on a conductive emitter electrode 71 and a second insulating layer 73 is provided between the conductive emitter electrode 71 and the cathode line 43 on the display substrate 44. The conductive emitter electrode 71 is connected with the cathode line 43 via a through hole 72 provided within the second insulating layer 73.

Here, the second insulating layer 73 is made of $SiO_2$ and has a thickness of about 0.01 to 1.0 $\mu$m. The emitter electrode is made of Mo, for example, and has a thickness of about 1 to 10 $\mu$m. The through hole 72 created by laser processing or the like is filled with a conductive material such as Cu by using a lithographic process.

Besides those, the gate electrode 41 for switching the emitter 42 is provided on the first insulating layer 48 in the same manner as the first embodiment. The opposed substrate 47 is also constructed in the same manner as the first embodiment.

Figure 5:
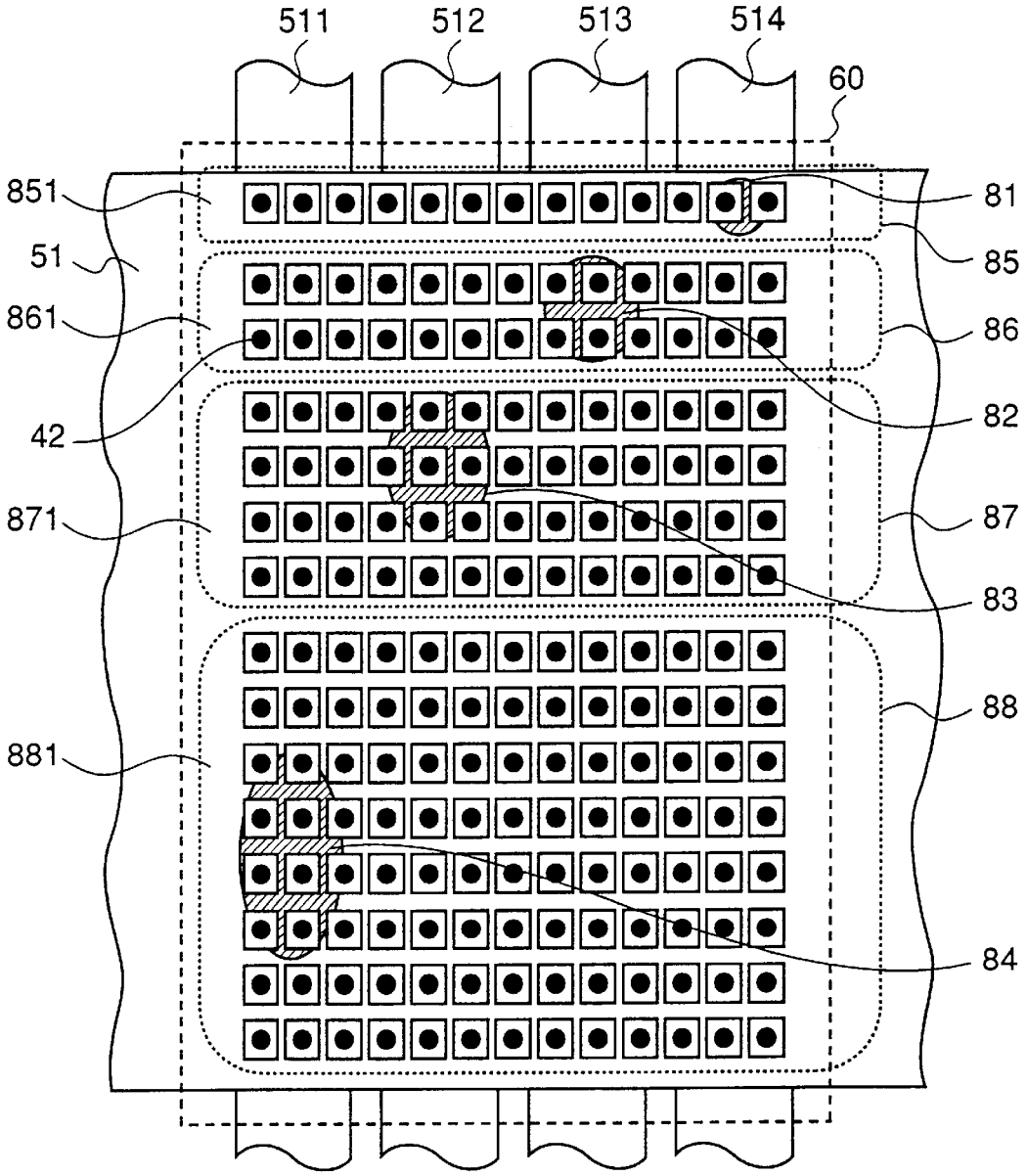
FIG. 5 is a diagram showing the structure of the array and display areas according to the second embodiment of the present invention.

FIG. 5 is a schematic diagram showing the array structure of the second embodiment.

One pixel 60 is divided into areas 85, 86, 87 and 88 so that the number of emitter elements 42 differs therein.

Emitter electrodes 851, 861, 871 and 881 are provided along the gate electrode 51 in the four areas 85, 86, 87 and 88. The emitter electrodes 851, 861, 871 and 881 are connected to the respective cathode lines 514, 513, 512 and 511 via through holes 81, 82, 83 and 84. The second insulating layer 73 electrically insulates the other cathode lines from the emitter electrodes.

Emitter elements 42 are formed on the four emitter electrodes 851, 861, 871 and 881, respectively. While the number of emitter elements within the area 85 is n, the number of emitter elements within the area 86 is 2n, the number of emitter elements within the area 87 is 4n and the number of emitter elements within the area 88 is 8n, FIG. 5 shows one in which 13 emitter elements 42 are provided within the area 85.

Because the cathode electrode, the second insulating layer and the emitter electrode may be fabricated by printing technology, the thickness of the second insulating layer may be very thick and the capacity between the cathode electrode and the emitter electrode may be very small, thus causing no crosstalk or power reduction or the like.

This pixel is driven in the same manner as the first embodiment. That is, in the state when the gate line 51 is selected, the emitter elements 42 in the area 85 turn ON when voltage is applied to a cathode line 514 and the emitter elements 42 in the area 86 turn ON when voltage is applied to a cathode line 513. Thus, luminance corresponding to an image signal may be rendered by applying voltage selectively to the four cathode lines 511, 512, 513 and 514.

The cathode lines 511, 512, 513 and 514 have an almost equal line width and deterioration of the image quality may be prevented by reducing the wiring resistance also in the present embodiment.

Figure 6:
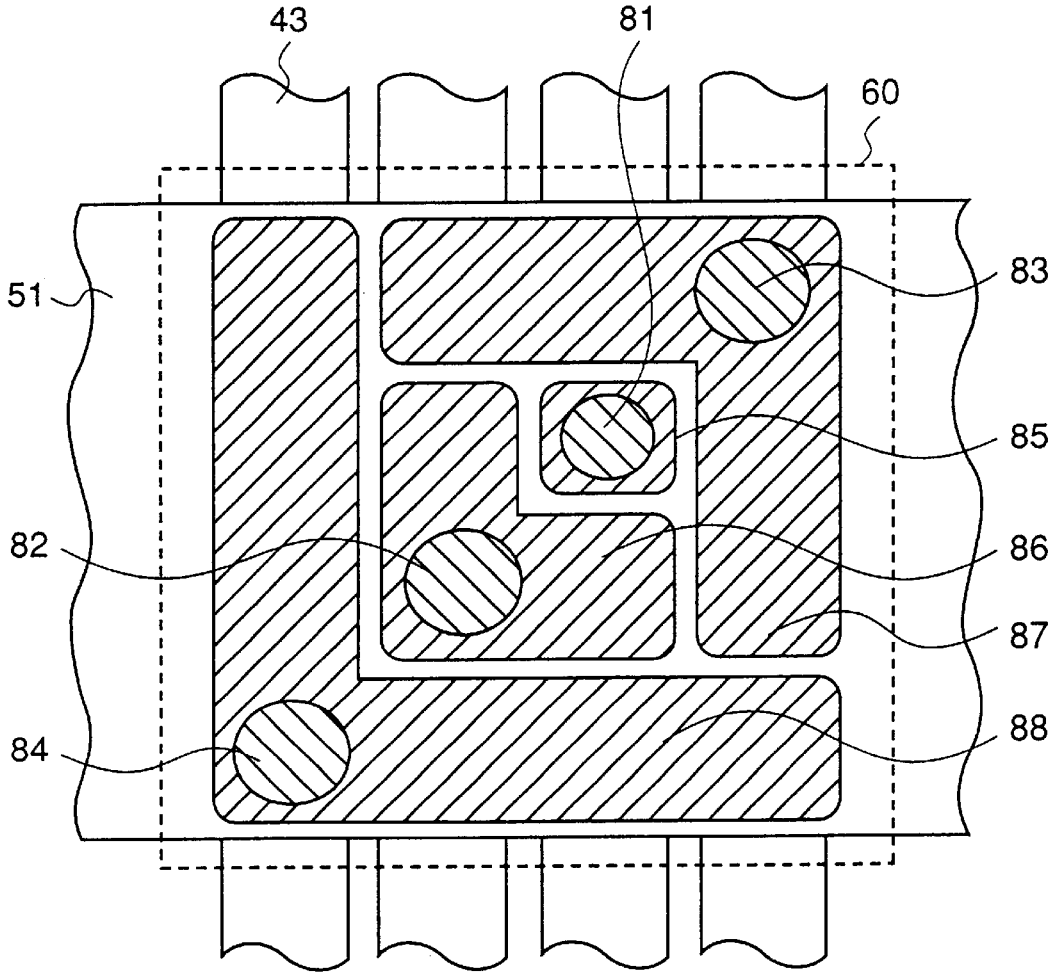
FIG. 6 is a diagram showing an emitter electrode pattern according to the second embodiment of the present invention.

When the areas 851, 861, 871 and 881 are provided in the horizontal direction in FIG. 5, they may be provided in another way. For instance, the areas 85, 86, 87 and 88 may be disposed as shown in FIG. 6, which is a diagram showing an emitter electrode pattern. At this time, the through holes 81, 82, 83 and 84 may be provided. It is also possible to array the through holes horizontally in a row. The detail of the same parts as those in the first embodiment is omitted in the figure.

When the areas 85, 86, 87 and 88 are disposed as described above, the smallest area 85 is isolated from the edge of the pixel, so that electrons emitted from the area 85 do not deviate out of the electron irradiating area on the opposed substrate. It is important in stably rendering the lowest luminance. Such disposition also allows nonuniformity within the pixel to be reduced.

A third embodiment is explained with reference to FIG. 7.

Figure 7:
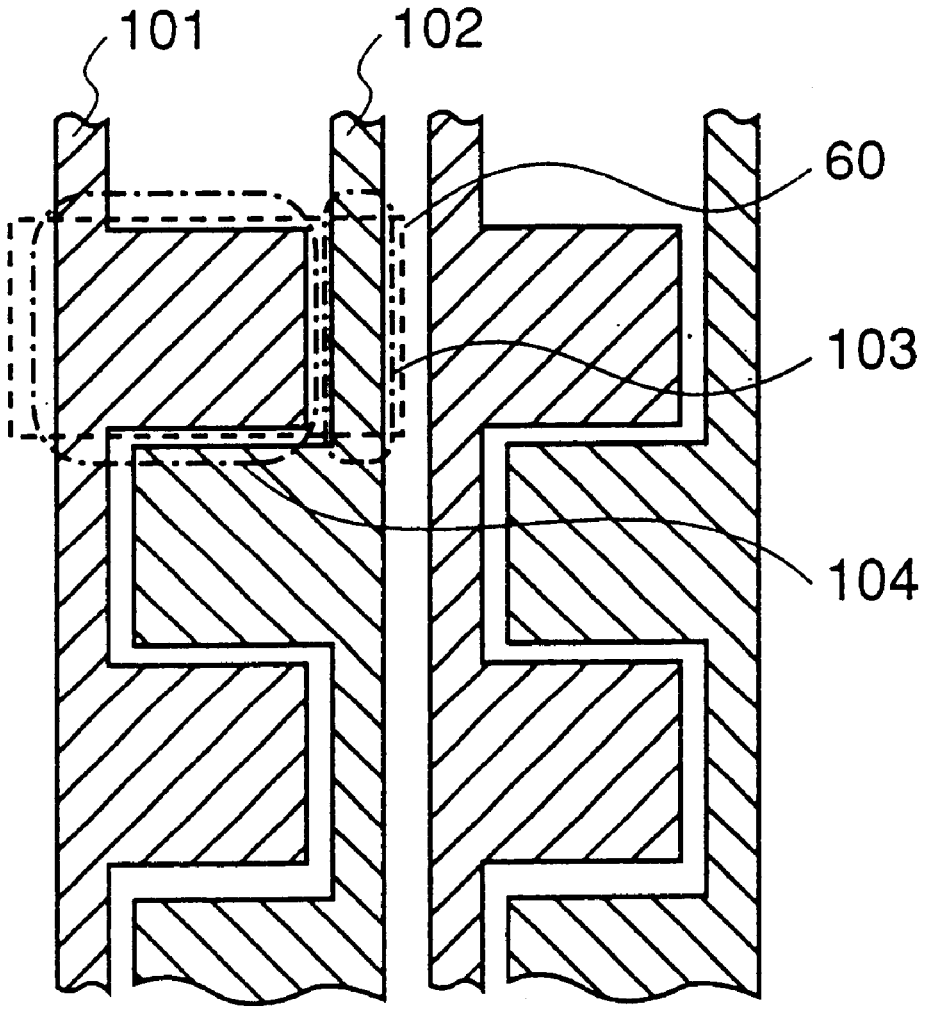
FIG. 7 is a diagram showing a cathode line pattern according to a third embodiment of the present invention.

FIG. 7 is a diagram showing a cathode line pattern according to a third embodiment of the present invention. A first cathode line 101 is provided with parts in which the line width is wide and thin one after another in the vertical direction and a second cathode line 102 adjacent thereto is also provided with parts in which the line width is wide and thin. The part 104 of the first cathode line 101 in which the line is wide is disposed so as to form a pair with the part 103 of the second cathode line 102 in which the line width is thin to form one pixel area 60.

Here, the line width of the part 104 in which the width of the cathode line is wide is about 75 $\mu$m and that of the part in which the width is narrow is about 25 $\mu$m. Although a cathode line has the two widths, each total area of one cathode line is substantially equal.

The pixel is divided into two parts by disposing as described above and four gradations may be rendered in the one pixel area 60.

Although not shown in FIG. 7, a gate line is provided on the one pixel area 60 in the row direction. The opposed substrate is also provided in the same manner as the first embodiment.

A fourth embodiment is explained with reference to FIG. 8.

Figure 8:
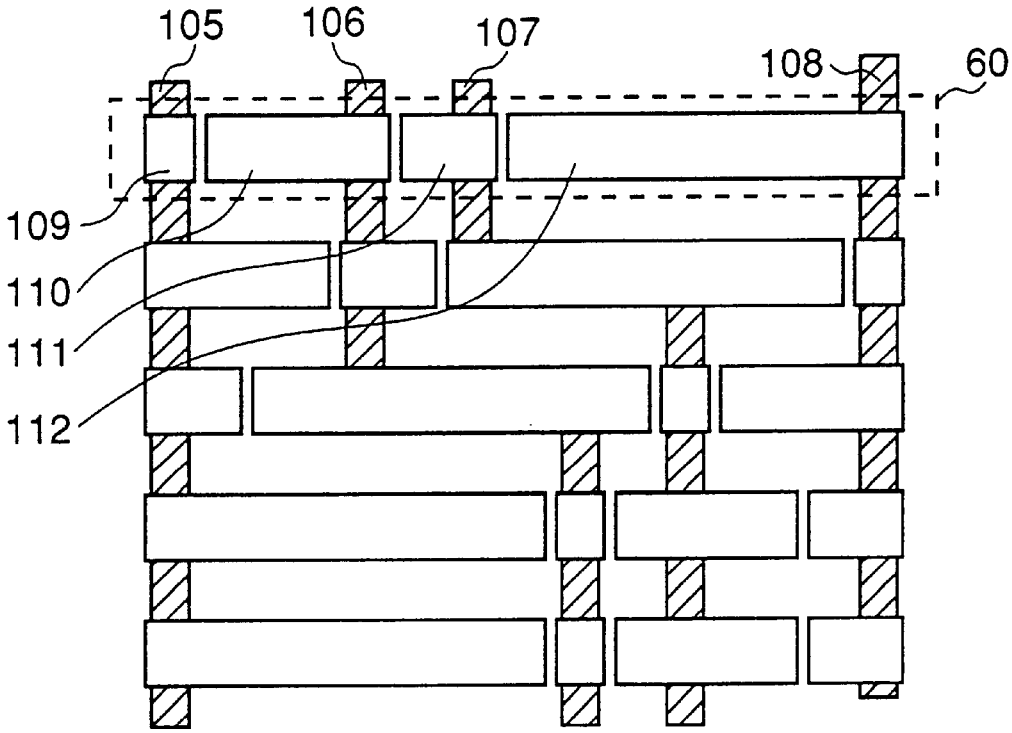
FIG. 8 is a diagram showing the ratios of display areas in the structure of array according to a fourth embodiment of the present invention.

FIG. 8 is a diagram showing the ratios of display areas in the structure of array according to a fourth embodiment of the present invention. Four areas 109, 110, 111 and 112 are formed by using four cathode lines 105, 106, 107 and 108. However, the cathode lines are not straight in this case. One pixel area 60 comprises the four areas 109, 110, 111 and 112.

In the present embodiment, the smallest area 109 to the largest area 112 may be formed using patterns to form the cathode lines by providing the cathode lines of four types of line width from the minimum one to the maximum one or the four areas 109, 110, 111 and 112 may be formed by emitter electrodes and through holes like the second embodiment.

Here, in the x-direction, the width of the smallest area 109 is about 6 $\mu$m, the width of the area 110 is about 24 $\mu$m, the width of the area 111 is about 12 $\mu$m and the width of the largest area 112 is about 48 $\mu$m.

The cathode lines 105, 106, 107 and 108 in the vertical direction are patterned as a set by four pixels and the pattern turns around from the pixel of the fifth column, thus forming a mirror pattern. This turn-around prevents the cathode line from being formed in the oblique direction.

Luminance of 16 gradations may be rendered by selectively turning ON the four areas 109, 110, 111 and 112.

Although not shown in FIG. 8, a gate line is provided in the row direction per one pixel area 60. The opposed substrate is also provided in the same manner as the first embodiment.

A fifth embodiment is explained with reference to FIG. 9, which is a diagram showing the differing number of emitters in the structure of the array.

According to the present embodiment, the number of divisions is reduced by setting the areal ratio of the field emission type emitter as $1:2:2^2$ through: $2^n$ (n is integer greater than 1).

Figure 9:
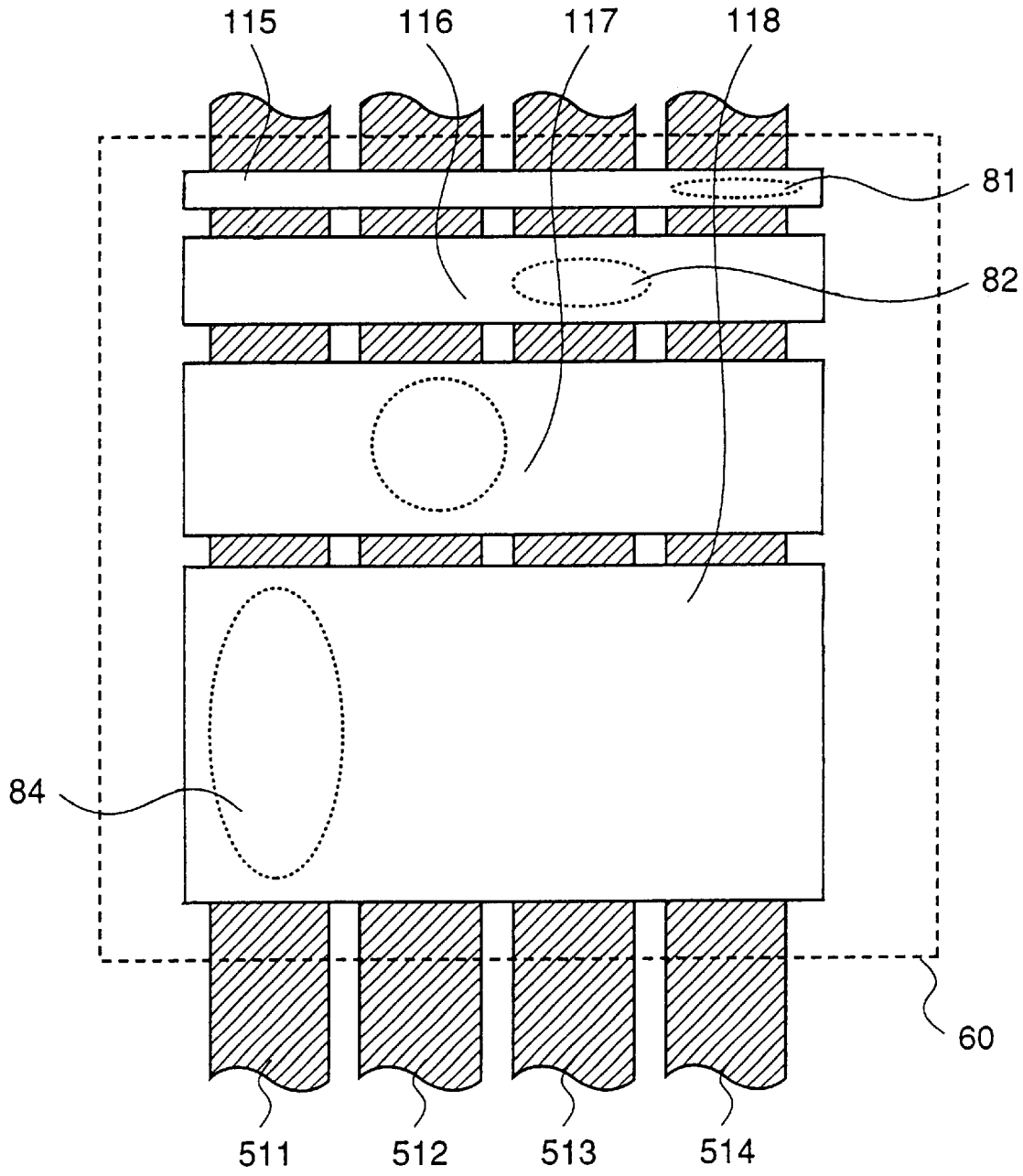
FIG. 9 is a diagram showing the differing numbers of emitters in the structure of array according to a fifth embodiment of the present invention.

Because the emitter elements are provided on the emitter electrodes as shown in FIG. 9, the emitter electrode corresponds to an area obtained by dividing a pixel. A quantity of emitted electrons is also proportional to the area of the emitter electrode, so that the luminance of the pixel is also proportional to the area of the emitter electrode which is ON.

In the present embodiment, the emitter electrodes 115, 116, 117 and 118 are formed with the ratio of 1:2:4:8. That is, when a pixel of 150 $\mu$m×450 $\mu$m is considered, for example, and when the pitch between the cathode lines is set at 10 $\mu$m, the width of the smallest is 28 $\mu$m, which is east to fabricate. The emitter electrodes 115, 116, 117 and 118 are connected to cathode lines 514, 513, 512 and 511 via the through holes 81, 82, 83 and 84.

Although not shown in FIG. 9, emitter elements are provided on the emitter electrodes 115, 116, 117 and 118 and a fate line is provided in the row direction per one pixel area 60. The opposed substrate is also provided in the same manner as the first embodiment.

The array structure of the present embodiment allows 16 gradations to be represented in which the 16-th gradation is represented when all of the areas are ON and the 0-th gradation is represented when all of the areas are OFF.

Figure 10:
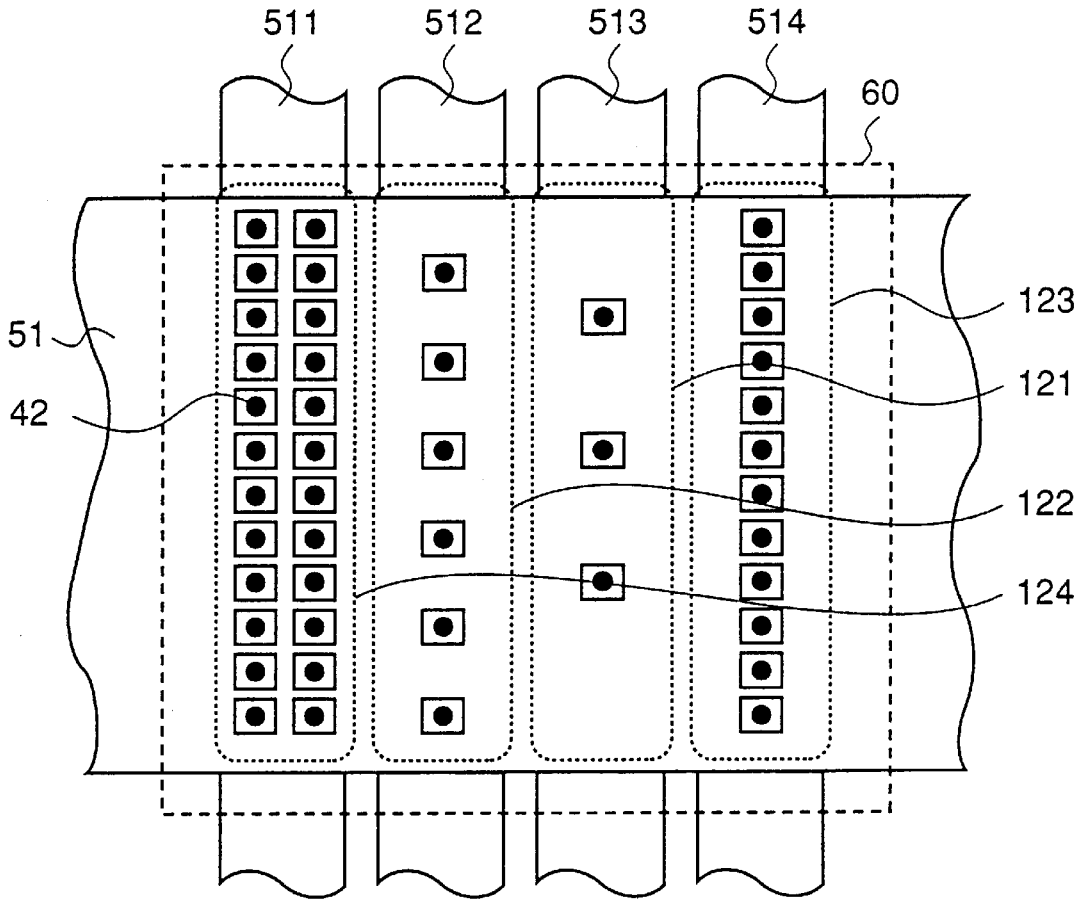
FIG. 10 is a diagram showing the structure of an array according to a sixth embodiment of the present invention.

A sixth embodiment is explained with reference to FIG. 10, which shows the structure of an array. As shown in FIG. 10, the emitter elements 42 are provided on areas 121, 122, 123 and 124 corresponding to four cathode lines 511, 512, 513 and 514 passing through the one pixel area 60 in the present embodiment. However, the number of emitter elements provided in each area is differentiated.

For instance, while the number of emitter elements within the area 121 is m, the number of emitter elements within the area 122 is 2m, the number of emitter elements with the area 123 is 4m and the number of emitter elements within the area 124 is 8m. FIG. 10 shows a case in which the number m of emitter elements within the area 121 is three.

Similar to the first embodiment, the gate line 51 is provided in the horizontal direction on one pixel area 60. It is noted that although not shown in FIG. 10, the opposed substrate is also provided in the same manner as the first embodiment.

By arranging as described above, the quantity of emitted electrons may be controlled and the display luminance may be controlled by selectively supplying voltage to the respective cathode lines 511, 512, 513 and 514.

Further, the areas 121 and 122 having a lesser number of emitter elements 42 are disposed at the center of the pixel and the areas 123 and 124 having a greater number of emitter elements 42 are disposed at the peripheral part so as to provide uniformity within the pixel.

According to the present embodiment, the ratio of the numbers of the emitter elements 42 may be set at 1:2:4:8. Thereby, the quantity of emitted electrons in the areas 121, 122, 123 and 124 may be set at 1:2:4:8. For instance the number of emitters in the area 121 is set at 100, the number of emitters in the area 122 is set at 200, the number of emitters in the area 123 is set at 400 and the number of emitters in the area 124 is set at 800 in FIG. 10. Actually, the number of emitters is much larger than that, so that the gradation is influenced less even when some of the emitters are destroyed.

A seventh embodiment is explained with reference to FIG. 11, which shows the structure of an array.

The structure of one pixel is the same as that of the fifth embodiment, so that its detail is omitted here.

Figure 11:
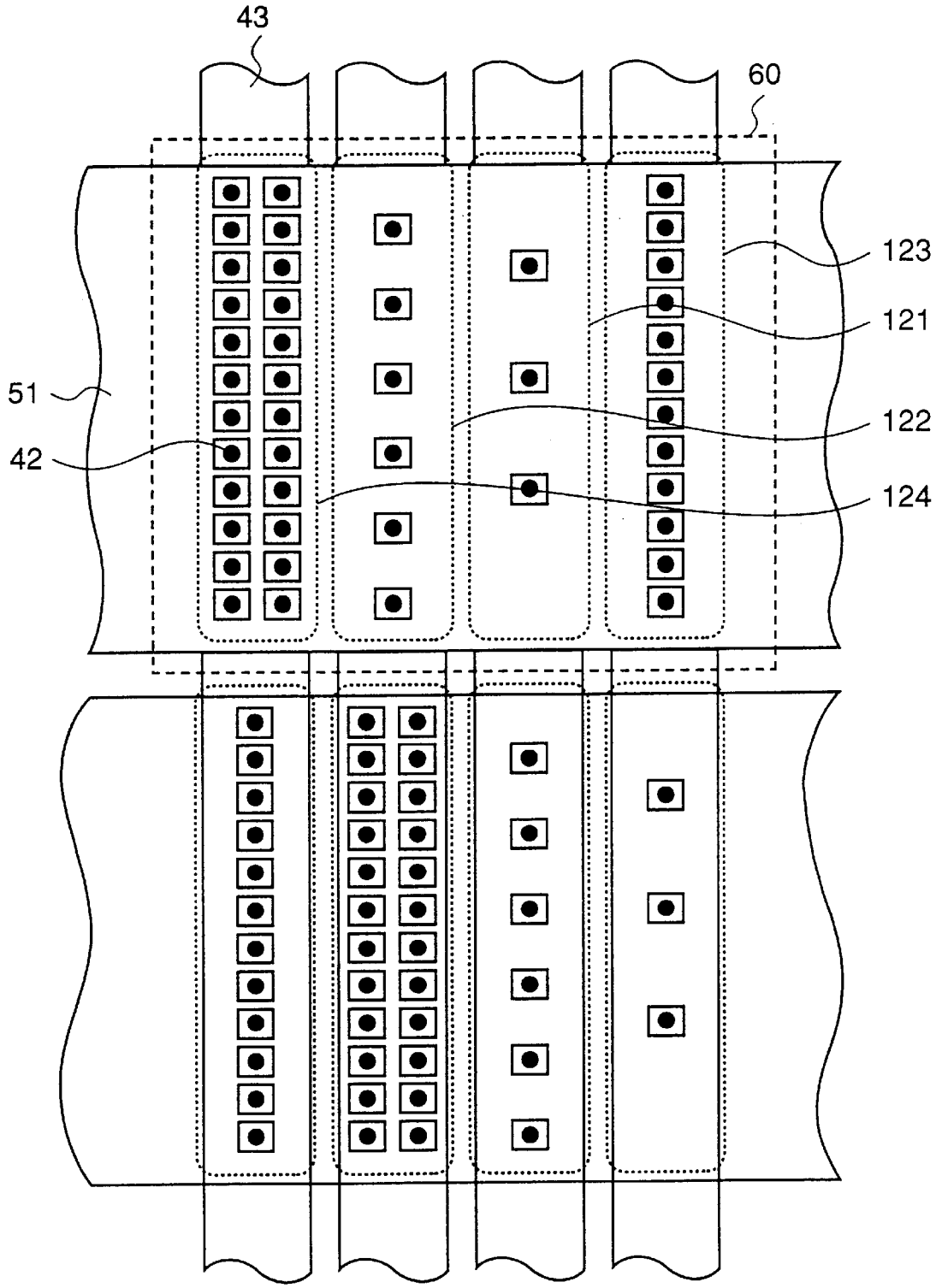
FIG. 11 is a diagram showing the structure of an array according to a seventh embodiment of the present invention.

The disposition of the emitter elements 42 is changed per pixel in the present embodiment as shown in FIG. 11. While the disposition of the emitters 42 is shifted from the upper pixel in the lower pixel in FIG. 11, it is possible to make the nonuniformity hardly visible by disposing them at random. The other arrangement is the same as that of the fifth embodiment.

An eighth embodiment is explained with reference to FIG. 12, which shows waveforms for driving the display device.

The present embodiment illustrates a driving method for representing multiple gradations by applying voltage of a pulse modulation signal modulated in the temporal direction or by supplying voltage of an amplitude modulation signal modulated in the voltage direction to the cathode line.

Figure 12:
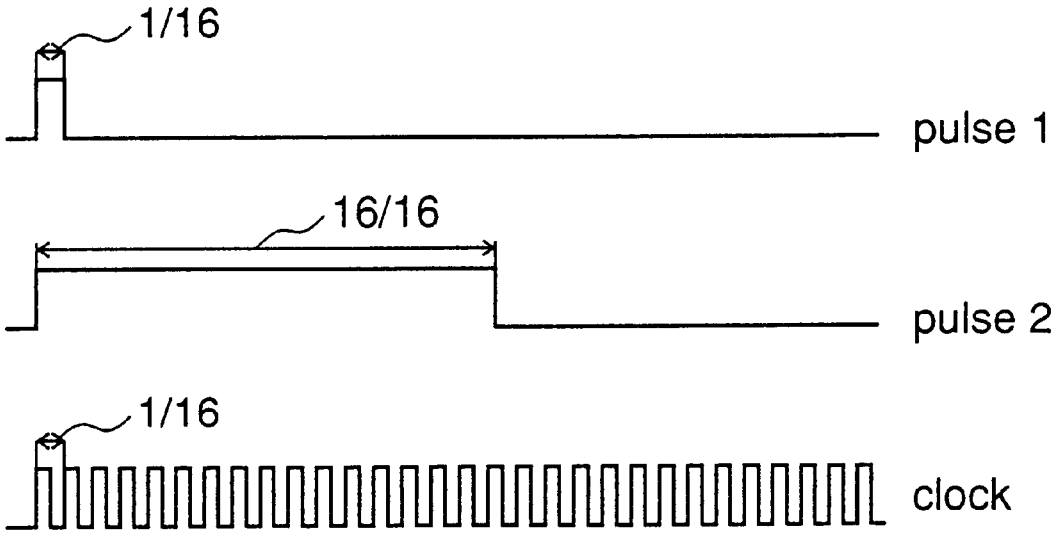
FIG. 12 shows an example of first signal waveforms according to an eighth embodiment of the present invention.

The gradation rendering method is explained by exemplifying a case when two types of modulation pulses 1 and 2 shown in FIG. 12 are applied to the pixel in FIG. 9. FIG. 12 shows waveforms of the signals supplied to the cathode line. In the figure, the horizontal axis represents time and the vertical axis represents voltage. The applied voltage is denoted as high potential (H) and low potential (O) for the convenience of the explanation. The period of H is $^{16}/_{16}$ when the luminance is maximum and the period of O is $^{0}/_{16}$ when the luminance is 0.

The modulation pulse 1 is a pulse which is H only during the period of $^{1}/_{16}$. The modulation pulse 2 is a pulse which is H only during the period of $^{16}/_{16}$ (H in the whole period).

When voltage modulated in the temporal direction is applied to the display whose pixel is constructed as shown in FIG. 9 for example as shown in FIG. 12, a quantity of luminescence L within one pixel may be expressed when applied time (H period) tn (n=1,2,3,4, . . . ) and area Sm (m=1,2,3,4, . . . ) are used, as the following expression (1);

$$L=\Sigma\Sigma tn*Sm \quad (1)$$

That is, the quantity of luminescence is proportional to the H period.

Table 1 shows changes of luminance of the pixel when the modulation pulses 1 and 2 are applied to the respective cathode lines 511, 512, 513 and 514. The areal ratio of the emitter electrodes is 1:2:4:8. Here, the luminance when the modulation pulse 1 is applied to the emitter electrode 115 is rendered as 1.

TABLE 1

Rendering of Gradation (Pulse Width × Area of Emitters)

| Areas of Emitters | Pulse 1 | Pulse 2 |
|---|---|---|
| 511 | 1 | 16 |
| 512 | 2 | 32 |
| 513 | 4 | 64 |
| 514 | 8 | 128 |

As it is apparent from Table 1, 8 bits (256 gradations) may be represented by the combination of the two types of modulation pulses and the four emitter electrodes.

Because the modulation pulse is formed based on $^{1}/_{16}$, the speed of the clock within the cathode line driving circuit may be also lowered to one based on $^{1}/_{16}$. Thus, the use of the two types of modulation pulses allows the number of luminous gradations to be readily increased.

Figure 13:
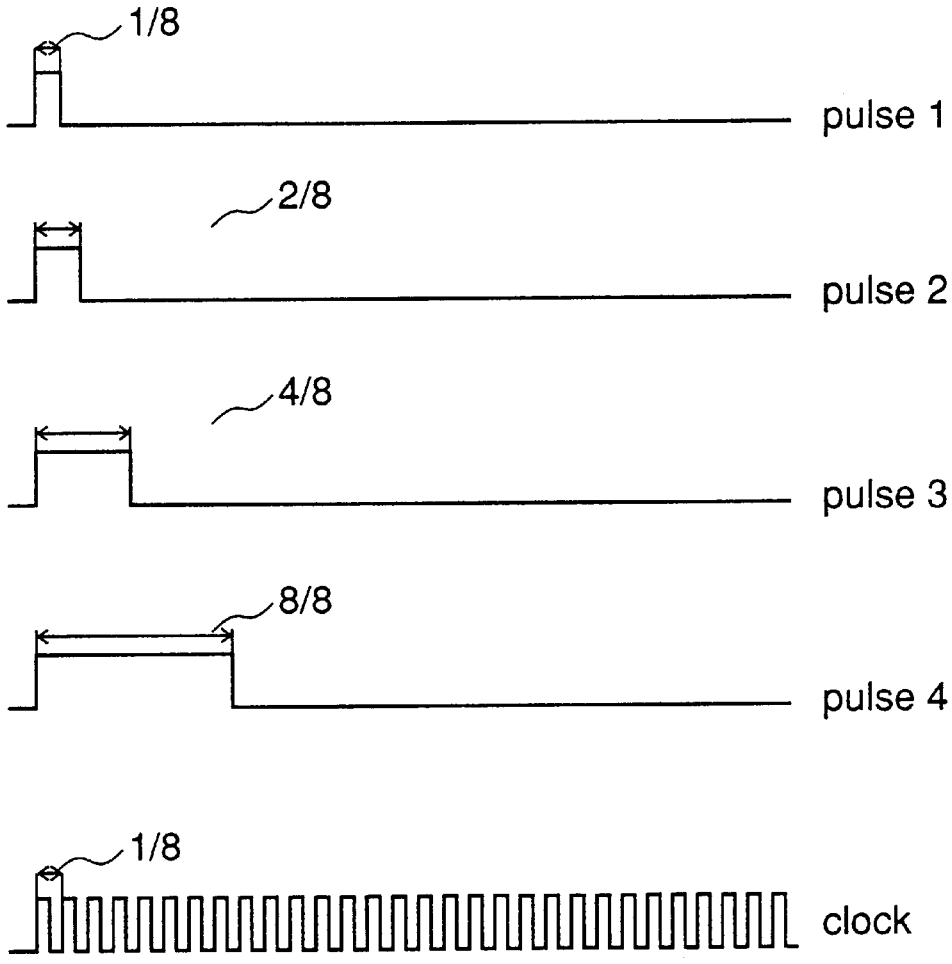
FIG. 13 shows an example of second signal waveforms according to the eighth embodiment of the present invention.

Table 2 shows a case in which four types of modulation pulses are applied by using the structure of the pixel in the third embodiment. FIG. 13 shows the exemplary four types of pulses for driving the display device.

Table 2 shows changes of luminance of the pixel when the modulation pulses 1, 2, 3 and 4 are applied to the respective areas 103 and 104 in FIG. 7. The areal ratio of the emitter electrodes is 1:16 and the luminance when the modulation pulse 1 is applied to the area 103 is rendered as 1. Accordingly, 256 gradations may be rendered by using the four types of modulation pulses.

TABLE 2

Rendering of Gradations (Pulse Width × Area of Emitters)

| Area of Emitters | Pulse 1 | Pulse 2 | Pulse 3 | Pulse 4 |
|---|---|---|---|---|
| 103 | 1 | 2 | 4 | 8 |
| 104 | 16 | 32 | 64 | 128 |

Figure 14:
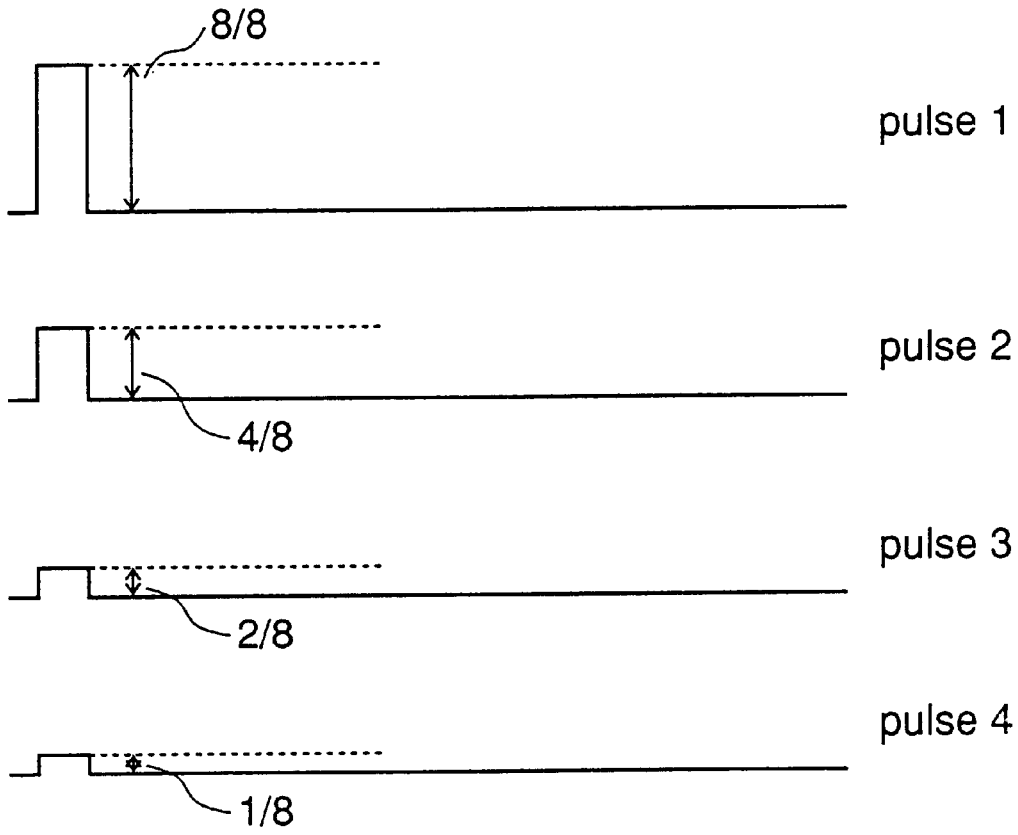
FIG. 14 shows an example of third signal waveforms according to the eighth embodiment of the present invention.

It is possible to render the multiple gradations also when the amplitude modulated signal is supplied by setting the amplitude ratio at $1:2:2^2$ to: $2^n$ (n is integer greater than 1) in the same manner and by using the array structure in which the area or the number of emitters are different. For instance, when four types of voltage amplitude pulses 1, 2, 3 and 4 shown in FIG. 14, for example, are applied to the pixel shown in FIG. 7, the luminance proportional to the areal ratio of the emitters and the voltage amplitude is rendered as shown in Table 3.

TABLE 3

Rendering of Gradations (Amplitude of Voltage × Area of Emitters)

| Areal Ratio of Emitters | Pulse 1 | Pulse 2 | Pulse 3 | Pulse 4 |
|---|---|---|---|---|
| 103 | 1 | 2 | 4 | 8 |
| 104 | 16 | 32 | 64 | 128 |

That is, the quantity of luminescence L within one pixel may be expressed by the following expression (2) by using the applied voltage Vn (n=1,2,3,4, . . . ) and the area Sm (m=1,2,3, 4, . . . ):

$$L=\Sigma\Sigma Vn*Sm \quad (2)$$

The table shows the changes of luminance of the pixel when the voltage amplitudes 1, 2, 3 and 4 are applied to the respective regions 103 and 104. The areal ratio of the emitter electrodes is 1:16 and the luminance when the voltage amplitude 1 is applied to the region 103 is represented as 1.

A ninth embodiment is explained with reference to FIG. 15, which is a diagram illustrating a splitting method. According to the ninth embodiment, the width of the gate line is changed for each cathode line per group of four cathode lines. While a case of four cathode lines is exemplified here, the width may be changed per groups of two of more cathode lines.

The cathode lines 511, 512, 513, 514, 515 and 516 whose line width is almost equal are provided in parallel with the vertical direction. Gate lines 518 and 519 are provided so as to cross the cathode lines at right angles. The cathode lines are insulated from the gate lines by an insulating film that is interposed therebetween.

The line width of the gate line 518 is maximized on the cathode line 511, is thinned stepwise on the cathode lines 512 and 513 and is minimized on the cathode line 514. The line width is minimized also on the cathode line 515 and is widened from the cathode line 516. Thus, it is formed such that the width of the gate line changes in groups of the four cathode lines. The line width of the adjacent gate line 519 is changed so that it is reversed from the gate line 518.

One pixel is formed approximately in a triangular shape in which the line width of the gate line 518 changes from the maximum to the minimum width on the four cathode lines 511, 512, 513 and 514.

Emitter elements 42 are formed on the cathode line in the area overlapping with the gate line 518.

A quantity of electrons emitted from the area is proportional to a number of emitter elements, and the quantity of electrons is proportional to the luminance. Accordingly, a part or all of emitter elements in the triangular pixel may be turned ON by applying voltage selectively to the cathode lines, thus rendering desirable luminance.

Figure 15:
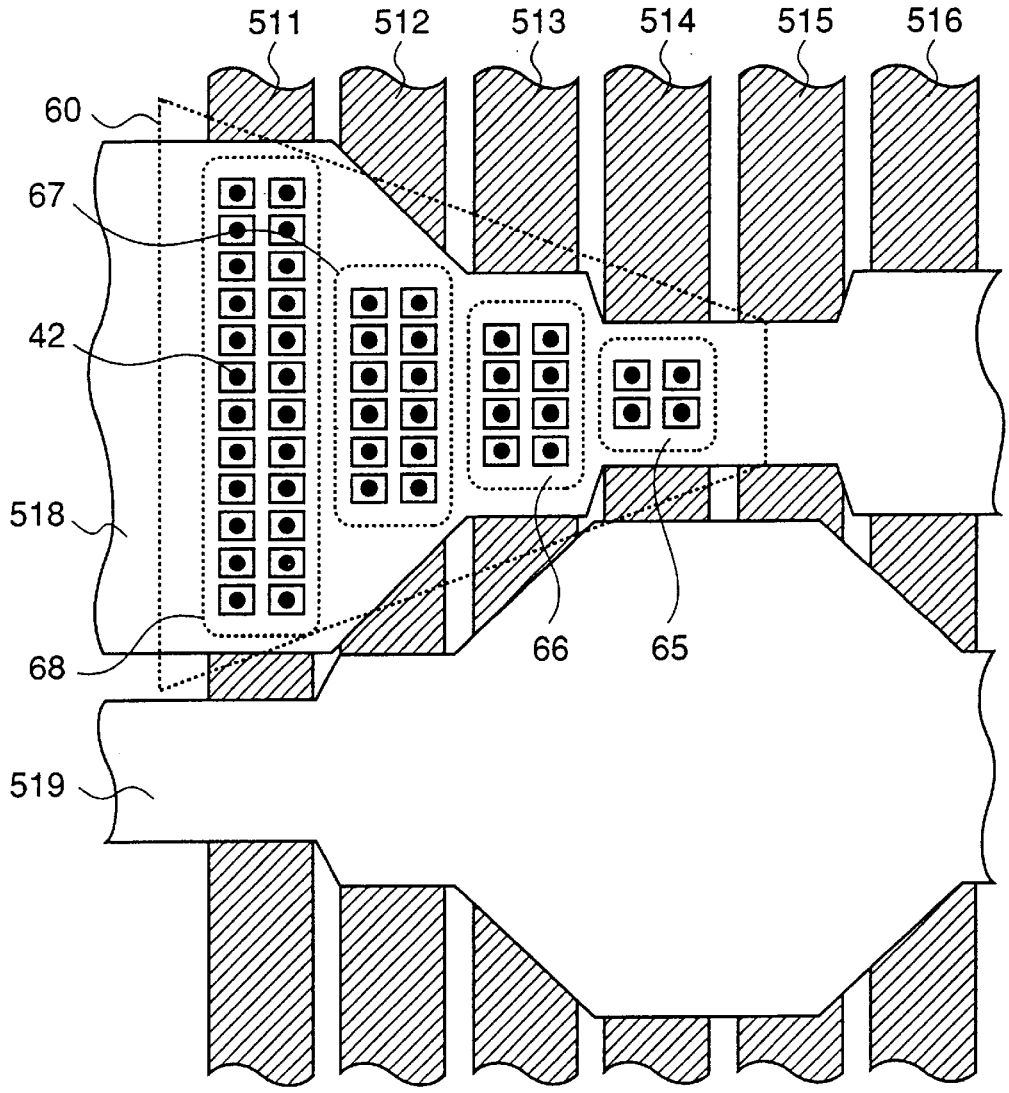
FIG. 15 is a diagram illustrating a splitting method of a device according to a ninth embodiment of the present invention.
Figure 16:
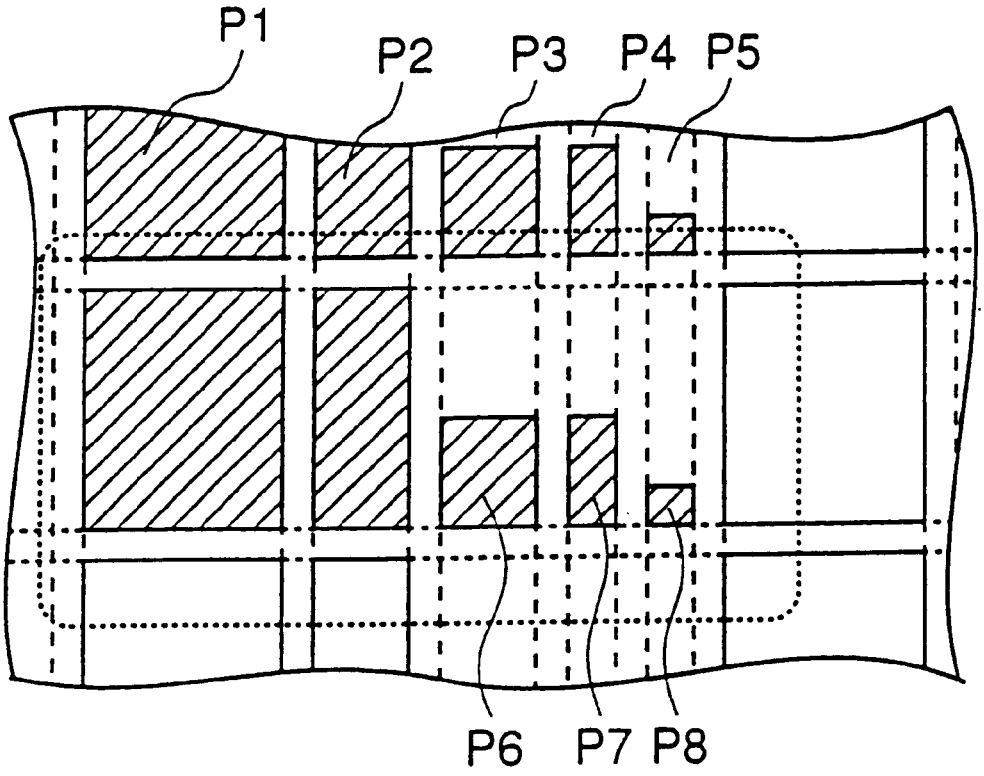
Fig.16 PRIOR ART
FIG. 16 is a diagram of a prior art liquid crystal display.

In FIG. 15, the gate line is formed into a diamond concatenated pattern by turning around the gate line width in the row direction. Such arrangement allows the gate lines to be disposed minutely, a high precision display to be formed and an effective area of the emitter element to be increased.

In addition, the gate line may be formed as a triangular repetitive pattern so that its width repeats from the minimum line width to the maximum line width and so on in the cycle of the four cathode lines.

Thus, according to the present invention, it is possible to provide a field emission type display which is capable of suppressing the deterioration of the image quality which otherwise occurs due to the stepwise cuts and to the increase of the wiring resistance caused by the thin width of the cathode line and which causes less failures by improving the conduction between the emitter electrode and the cathode line.

While the respective embodiments of the present invention shown in the figures have been explained, the method for dividing the cathode lines, the shape of the emitter electrode, the pulse width modulating method and the like are not limited to those in the respective embodiments of the present invention and may be modified and embodied in various ways within the scope of the spirit of the invention.

What is claimed is:

1. A field emission display element comprising:

an anode;

a fluorescent layer on said anode;

a board spaced apart from said anode;

a plurality of cathode lines parallel to each other on said board;

an insulating layer on said cathode lines;

a gate electrode disposed on said insulating layer, and above said plurality of cathode lines; and a plurality of emitter elements connected to said cathode lines, said emitter elements exposed from openings on said gate electrode and said insulating layer, wherein a cross point of said plurality of cathode lines and said gate electrode forms a pixel, and numbers of said emitter elements connected to each cathode line are different in said pixel.

2. A field emission display element according to claim 1, wherein widths of said cathode lines are substantially equal.

3. A field emission display element according to claim 1, wherein said numbers of said emitter elements increase from one side to the other side in said pixel.

4. A field emission display element according to claim 1, wherein said numbers of said emitter elements have a constant ratio.

5. A field emission display element according to claim 1, wherein said plurality of cathode lines has four of said cathode lines.

6. A field emission display according to claim 1, wherein widths of said emitter electrodes are different from each other.

7. A field emission display element according to claim 1, wherein an area of said emitter elements connected to one of said cathode lines is formed above said one of said cathode lines.

8. A field emission display element according to claim 1, wherein said plurality of cathode lines comprises a first cathode line and a second cathode line, said first cathode line and said second cathode line having a wide part and a thin part, said wide part of said first cathode line is next to said thin part of said second cathode line and said thin part of said first cathode line is next to said wide part of said second cathode line.

9. A field emission display according to claim 8, wherein one of said cathode lines is connected by one of said emitter electrodes.

10. A field emission display according to claim 8 wherein the wide part of the first cathode line and the thin part of the second cathode line are part of a first pixel and the thin part of the first cathode line and a wide part of the second cathode line are part of a second pixel.

11. A field emission display according to claim 1, wherein said emitter elements are dispersed above said cathode lines in said pixel.

12. A field emission display element according to claim 1, wherein the number of emitter elements in a center part of said pixel is smaller than that in perimeter parts of said pixel.

13. A field emission display comprising a plurality of display elements claimed in claim 1.

14. A field emission display according to claim 13, wherein numbers of said emitter elements on one of said cathode lines in two adjacent pixels are different.

15. A field emission display according to claim 13, wherein said gate electrode has a wide part and a thin part, said wide part is adjacent to a thin part of an adjacent gate electrode and said thin part is adjacent to a wide part of said adjacent gate electrode.

16. A field emission display according to claim 13, wherein said areas of said emitter electrodes increase as $2^n$ (n: an integer number).

17. A field emission display element comprising:

an anode;

a fluorescent layer on said anode;

a board spaced apart from said anode;

a plurality of cathode lines parallel to each other on said board;

a first insulating layer having through holes and disposed on said cathode lines;

a plurality of emitter electrodes on said first insulating layer, each of said emitter electrode connected to one of said cathode lines via a contact in a respective one of said through holes;

a second insulating layer;

a gate electrode on said second insulating layer, said gate electrodes being above said cathode lines; and a plurality of emitter elements formed on said emitter electrodes, said emitter elements exposed from openings on said gate electrode and said second insulating layer, wherein a cross point of said plurality of cathode lines and said gate electrode forms a pixel, and numbers of said emitter elements connected to each cathode line are different in said pixel.

18. A field emission display comprising a plurality of display elements claimed in claim 17.

19. A field emission display according to claim 18, wherein an area of said emitter elements connected to one of said cathode lines is formed above a plurality of said cathode lines.

20. A field emission display according to claim 19, wherein said areas have a constant ratio.

21. A field emission display according to claim 18, wherein a first area of said emitter elements connected to a first cathode line in said plurality of cathode lines is formed above one of said cathode lines, a second area of said emitter elements connected to a second cathode line is said plurality of cathode lines is formed above two of said cathode lines.

22. A field emission display according to claim 21, wherein a third area of said emitter elements connected to a third cathode line in said plurality of cathode lines is formed above three of said cathode lines, a fourth area of said emitter elements connected to a fourth cathode line in said plurality of cathode lines is formed above four of said cathode lines.

23. A field emission display element according to claim 17, wherein said through holes are placed diagonally in said pixel.

24. A driving method for a field emission display having an anode; a fluorescent layer on said anode; a board spaced apart from said anode; a plurality of cathode lines parallel to each other on said board; an insulating layer on said cathode lines; a gate electrode on said insulating layer and above said cathode lines; a plurality of emitter elements connected to said cathode lines and exposed from openings on said gate electrode and said insulating layer, wherein a cross point of said plurality of cathode lines and said gate electrode forms a pixel, numbers of said emitter elements connected to each cathode line are different in said pixel, comprising:

impressing a pulse selected from pulses having different duty ratios to at least one of said cathode lines corresponding to an image signal for said pixel.

25. A driving method for a field emission display according to claim 24, wherein said pulse is selected from two types of pulses or four types of pulses.

26. A driving method for a field emission display having an anode; a fluorescent layer on said anode; a board spaced apart from said anode; a plurality of cathode lines parallel to each other on said board; an insulating layer on said cathode lines; a gate electrode on said insulating layer and above said cathode lines; a plurality of emitter elements connected to said cathode lines and exposed from openings on said gate electrode and said insulating layer, wherein a cross point of said plurality of cathode lines and said gate electrodes forms a pixel, numbers of said emitter elements connected to each cathode line are different in said pixel, comprising:

impressing a pulse selected from pulses having different intensities to at least one of said cathode lines corresponding to an image signal for said pixel.

27. A field emission display comprising:

an anode;

a fluorescent layer on said anode;

a plurality of cathode lines parallel to each other and disposed spaced apart from said anode;

an insulating layer disposed on a side of said plurality of cathode lines facing said anode;

a plurality of gate electrodes disposed on said insulating layer between said plurality of cathode lines and said anode, a cross point of each of said plurality of gate electrodes and a corresponding group of cathode lines of said plurality of cathodes lines forming a pixel; and a plurality of emitter elements connected to said cathode lines, each of said emitter elements being exposed through a corresponding opening in said gate electrode and said insulating layer, number of said emitter elements connected to each cathode line in a pixel being different.

* * * * *